US005795438A

United States Patent [19]

Stromberg et al.

[11] Patent Number: 5,795,438

[45] Date of Patent: Aug. 18, 1998

[54] METHOD AND APPARATUS FOR FEEDING MULTIPLE DIGESTERS

[75] Inventors: C. Bertil Stromberg, Glens Falls; Bruno S. Marcoccia; J. Wayne Chamblee, both of Queensbury, all of N.Y.

[73] Assignee: Ahlstrom Machinery Inc., Glens Falls, N.Y.

[21] Appl. No.: 744,857

[22] Filed: Nov. 4, 1996

[51] Int. Cl.[6] ..... D21C 7/06

[52] U.S. Cl. ..... 162/52; 162/56; 162/237; 162/241; 162/246

[58] Field of Search ..... 162/17–19, 52, 162/56, 237, 241, 246

[56] References Cited

U.S. PATENT DOCUMENTS

| | | | |
|---|---|---|---|
| 2,359,543 | 10/1944 | Branzell et al. . | |
| 2,459,180 | 1/1949 | Richter . | |
| 3,007,839 | 11/1961 | Richter . | |
| 3,298,899 | 1/1967 | Laakso . | |
| 3,322,616 | 5/1967 | Hutchinson et al. . | |
| 3,388,038 | 6/1968 | Ilander | 162/246 |
| 3,427,218 | 2/1969 | Richter . | |
| 3,429,773 | 2/1969 | Richter . | |
| 3,532,594 | 10/1970 | Richter . | |
| 3,554,864 | 1/1971 | Richter . | |
| 3,578,554 | 5/1971 | Richter . | |
| 3,579,418 | 5/1971 | Ostberg . | |
| 3,802,956 | 4/1974 | Backlund . | |
| 3,843,468 | 10/1974 | Laakso | 162/17 |
| 3,849,247 | 11/1974 | Richter . | |
| 4,104,113 | 8/1978 | Sherman et al. . | |
| 4,123,318 | 10/1978 | Sherman . | |
| 4,432,836 | 2/1984 | Sherman et al. . | |
| 4,690,731 | 9/1987 | Hartler et al. . | |
| 5,053,108 | 10/1991 | Richter . | |
| 5,236,553 | 8/1993 | Richter . | |
| 5,300,195 | 4/1994 | Richter et al. . | |
| 5,476,572 | 12/1995 | Prough . | |
| 5,500,083 | 3/1996 | Johanson . | |

*Primary Examiner*—Donald E. Czaja
*Assistant Examiner*—Steven B. Leavitt
*Attorney, Agent, or Firm*—Nixon & Vanderhye P.C.

[57] ABSTRACT

A number of distinct parallel digesters are fed with chips from a common steaming vessel. After steaming the chips are slurried and pressurized, and substantially simultaneously the steamed, slurried, and pressurized chips are transferred to at least some of (and typically each of) the distinct parallel digesters. A material stream is split into a number of individually controllable material streams (one for each of the digesters) either at the discharge from the steaming vessel, after slurrying (or at the discharge from a slurrying vessel), or after pressurizing (e.g. in a high pressure transfer device). For example a multi-branch conduit may be connected to the slurry outlet from the high pressure transfer device, the conduit having a branch directly connected to each of the digesters. A distinct return conduit may also be provided from each of the digesters to the high pressure transfer device, each return conduit preferably has a distinct flow control device and/or pump which are individually controlled.

20 Claims, 6 Drawing Sheets

Chip Supply
10
Chip Steaming
11
Chip Slurrying
12
Slurry Pressurized Transfer
13
23
24
25
125
Digesting 1
14
Digesting 2
114

Chip Supply
10
Chip Steaming
11
Chip Slurrying
12
20
21
22
122
Slurry Pressurized Transfer 1
13
Slurry Pressurized Transfer 2
113
19
119
Digesting 1
14
Digesting 2
114

METHOD AND APPARATUS FOR FEEDING MULTIPLE DIGESTERS

BACKGROUND AND SUMMARY OF THE INVENTION

The invention relates to a novel method and apparatus for feeding comminuted cellulosic fibrous material to two or more chemical pulping digesters, for producing chemical pulp.

The capacity of conventional chemical pulping systems has risen dramatically in recent years. In the 1960s, systems having capacities of 1000 tons per day (T/D) first appeared. Now, in the mid 1990s, pulp mills are typically being proposed and built having capacities exceeding 2000 T/D. These systems are typically "single-line" fiber line systems in which the raw material enters at one end and follows a single path to the discharge of pulp at the other end. With ever increasing global demands for paper and paper board, the capacity of individual mills, both new and existing, are only limited by the ability of equipment suppliers to build such mills.

However, these production rates dictate the size of the vessels used to process cellulose material to produce pulp. Such vessels, that is, either continuous or batch digesters, are designed based upon, among other things, the treatment times required to effect the desired degree of treatment and the capacity to uniformly treat the material to produce a relatively uniform product. For example, the diameter of such typically cylindrical digesters is a function of how uniformly the treatment chemicals and temperature can be distributed across the bed of comminuted cellulosic fibrous material. Typically, for continuous digesting vessels, the ratio of the vessel's height (L) to the vessel's diameter (D), that is, the L-over-D ratio, L/D, varies from 5 to 10, and is typically between 7 and 9. That is, the height of a vessel is much larger than the diameter. However, as the capacity increases, either the vessel must be built taller or two or more vessels in series must be used to treat the material. There is a practical limit to the height and diameter of a vessel and to the number of vessels used. For example, as the height of a vessel increases, the cost of providing sufficient support, piping and human access to the vessel increases and eventually becomes cost-prohibitive. As the diameter of the vessel increases, more space, that is, a larger "footprint" is required. Also, larger diameter vessels are less conducive to shop-fabrication—they must be fabricated on-site, at a higher cost.

In the early days of continuous cooking, that is, in the 1940s, the system initially designed by Richter typically included two pressurized cooking vessels in series having an intermediate washer between them, as shown in SE 106,660 (illustrated in Richter's "The History of Kamyr Continuous Cooking", 1981, p. 2). A two-vessel system is shown in U.S. Pat. No. 2,359,543 in which the first cooking vessel is an upflow vessel and the second a down-flow vessel. As explained by Richter, this two-vessel design gave way to a single-vessel design, for example, as shown in U.S. Pat. No. 2,459,180. Other single-vessel systems are shown in U.S. Pat. Nos. 3,007,839; 3,097,987; 3,298,899; 3,429,773; and 3,427,218. Single-vessel systems prevailed in the 1950s and early 1960s.

In the late 1960s and early 1970s two-vessel vapor-phase continuous digesters began to appear, as shown for example in U.S. Pat. Nos. 3,532,594; 3,579,418; and 3,802,956. These two-vessel, vapor-phase systems were then advantageous because the cellulose material could be more effectively heated by a direct exposure to a then-inexpensive source of steam. As described by Richter, this use of direct heating using steam was an outgrowth of experiences with prehydrolysis kraft cooking. By using steam heating, the number of cooking circulations typically used to heat in a hydraulic digester could be reduced or eliminated.

The two-vessel hydraulic digester, as shown in U.S. Pat. No. 4,104,113, was introduced in the mid 1970s. As disclosed in this patent, the thermal inefficiencies of the vapor phase digester were addressed by introducing indirect heating of the cellulose material in the circulation which transferred the material from the first vessel, the impregnation vessel, to the second vessel, the digester. In addition the '113 patent introduced the concept of transferring the impregnated material between vessels by flushing the material with hot liquor, or what is referred to as "sluicing" the material from the first vessel to the second vessel. This inter-vessel heating also reduced or eliminated the need for cooking circulation screens in the digester. An improvement to the two-vessel system is described in U.S. Pat. No. 4,432,836 which introduced the concept of providing a "false bottom" to the outlet of the first vessel to facilitate sluicing.

In U.S. Pat. No. 4,123,318, a three-vessel system was introduced. As disclosed in this patent, it was proposed that such a multi-vessel system would be easier to fabricate than existing two-vessel systems. It was also suggested that having three separate vessels for impregnation, digestion and washing provided the opportunity of designing each vessel, for example, its diameter, to meet the specific requirements of each treatment. This is an option not available to vessels in which two or more of these treatments were combined. However practical it appeared at the time, the three-vessel system never became a commercial reality.

In addition to increasing the number of vessels in a continuous digester system, various systems have been proposed for feeding one or more vessels with two or more feeding systems. For example, U.S. Pat. Nos. 3,322,616 and 3,388,038 disclose two methods of feeding a single digester with two separate feeding systems. U.S. Pat. No. 3,554,864 proposed that material be fed by two sources: one fed to a central inlet and the second to an outer annular area. U.S. Pat. No. 3,579,418 proposed a two-vessel system in which larger material, for example, chips, are fed to the inlet of a first vessel and small cellulose particles, that is, "fines" or "sawdust", are separately introduced to the flow of treated chips between the two vessels before being treated together in the second vessel.

Further examples of attempts to accommodate larger production rates while minimizing the size of the vessels are shown in U.S. Pat. Nos. 5,300,195; 5,053,108; and 5,236,553. These patents disclose various two-vessel systems including a first up-flow vessel followed by a downflow vessel. Included in these systems is a system in which the initial up-flow vessel is located physically inside and concentric with the second down-flow vessel. None of these systems have become commercially successful.

U.S. Pat. Nos. 3,843,468 and 3,849,247 disclose two similar methods of feeding two digesters using a single feed system. The systems disclosed in these patents include a screw-type separating device that screens and distributes a pressurized slurry of chips and liquor to two separate digesters. Since these separating devices propel the chip slurry by means of a mechanical screw they have the limitation of having to be located adjacent to and above the inlet of the digesters to which they feed. Not only does this require the location and additional support for the device, its piping and power source (typically an electric motor and gear reducer) at the top of a digester that is typically 100 to 120 feet in height, this device also requires that the digesters being fed be in very close proximity to each other. A further limitation of the systems shown in these patents is that there is limited control and no monitoring of the flow of chips to each digester. Though ideally the disclosed device distributes the chips to lo two or more digesters as desired there are no controls for monitoring and regulating these individual chip flows or their corresponding cooking liquor flows to each digester.

Another means of feeding one or more digesters is disclosed in recently-issued U.S. Pat. No. 5,476,572. This patent discloses a novel method marketed under the trademark LO-LEVEL by Ahlstrom Machinery Inc. of Glens Falls, N.Y. which includes the feeding of two or more digesters by means of a slurry pump. The discharge from the pump can be divided into two or more flows which feed separate high-pressure transfer devices, that is, high-pressure feeders. The high-pressure transfer devices, with their appropriate liquor circulations then feed separate digesters.

The present invention includes a method and apparatus for feeding two or more digesters, either continuous or batch, from a single source of comminuted cellulosic fibrous material while circumventing the limitations of the prior art systems discussed above. In addition, by providing a system that can feed chips to multiple digesters, the height and diameter of each vessel, based on the preferred L/D ratio, become more feasible from an economic, ergonomic, and process point of view. In particular, the diameter of each vessel may be limited to enhance the potential for facilitating fabrication, installation and expansion.

The following discussion will solely refer to wood chips, either hardwood or softwood, but it is to be understood that any other form of comminuted cellulosic fibrous material can be used, for example, bagasse, straw, kenaf, grasses, recycled fiber, or agricultural waste, among other sources. It is preferred that the division of the chip supply be located as far from the source of the chip supply as possible in order to limit the number of vessels or pieces of equipment that are duplicated. For example, in the U.S. Pat. Nos. 3,843,468 and 3,849,247 the chip slurry is divided just before the inlets of the digesters. However, depending on the physical constraints of the pulp mill, the process chemistry desired, or the controllability of the division of chip flow, the chip feed system may be divided into separate streams wherever necessary.

One embodiment of this invention uses of a vessel in which chips are initially treated having two or more outlets. For example, a DIAMONDBACK® steaming vessel, as sold by Ahlstrom Machinery, having two or more outlets having a geometry exhibiting one-dimensional convergence and side relief as shown in FIG. 6 of U.S. Pat. No. 5,500,083.

However, unlike U.S. Pat. No. 5,500,083, each outlet may feed a separate metering or transfer device, such as feed screws or star-type feeders, such as Low-Pressure Feeders (LPF) also sold by Ahlstrom Machinery, which ultimately are operatively connected to separate digesters. Also unlike in the 5,500,083 patent, more than two outlets may be used, for example, three or more outlets may be used, to feed separate individual metering or transfer devices.

In another embodiment, the single discharge of a pretreatment vessel, for example, a DIAMONDBACK® steaming vessel, may feed a metering device having more than one outlet. For example, the outlet of the steaming vessel may feed the inlet of a screw conveyor having oppositely directed screws with separate discharges which operatively communicate with separate digesters.

In another embodiment of this invention, the single discharge from a metering device, for example, an LPF, can feed a cylindrical vessel having two or more outlets which feed two or more high-pressure transfer devices, for example High-Pressure Feeders (HPF) sold by Ahlstrom Machinery, or two or more slurry pumps, for example, "Hidrostal" pumps sold by the Wemco Company of Salt Lake City, Utah. This cylindrical vessel may be a Chip Chute as sold by Ahlstrom Machinery having an outlet containing two or more discharges exhibiting one-dimensional-convergence and side relief.

In another embodiment of this invention, a single steaming vessel, metering device, and chip chute may feed a transfer device having a bifurcated discharge. For example, the transfer device may be a HPF having a discharge that feeds two or more conduits which operatively communicate with separate digesters. The transfer device may be a slurry-type pump and HPF combination which feeds two or more conduits which communicate with separate digesters. The division of flow may be effected by means of a flow-divider that is integral with the outlet of the HPF or the flow division may be effected by a downstream flow-divider, such as a Flow Discharger as sold by Ahlstrom Machinery, or the division may simply be effected by a bifurcated or multi-branched pipe or conduit.

In a preferred embodiment of this invention, the two or more digesters that are fed by this system have separate individually controllable cooking liquor additions and separate level controls. This means for regulating liquor addition to the two or more digesters may be dependent upon one or more different parameters. For example, the addition of liquor to each vessel may be varied depending upon the residual alkali present in the spent cooking liquor. The liquor addition may also be determined by the pressure in each digester, for example, the pressure in a hydraulic digester, assuming other flows, e.g. extraction flows, are equal. Also, liquor and chip levels in each of the digesters may be used as a basis for cooking chemical addition, for example, the liquor level in a steam-phase digester. In addition, even a flow of liquid to or from a digester may be used as an indication of cooking liquor demand.

The preferred embodiment of the invention also includes some device for monitoring and controlling the flow of chips to each of the digesters (a function that was distinctly missing from the prior art shown in U.S. Pat. Nos. 3,843,468 and 3,849,247). This control may be by way of a physical restriction, for example a valve or flow dividing device, or by using a liquor flow to or from the digesters, for example a top circulation return flow from a digester. Furthermore, knowledge of the chip flow to each digester permits the independent control of cooking liquor flow to each digester as a function of chip flow.

The digesters that are fed by the present invention may be continuous or batch digesters performing any typical chemical pulping process, for example, kraft or sulfate pulping, sulfite pulping, soda pulping, solvent pulping or modifications thereof. For example, these inventions can be used to feed Lo-Solids® or EMCC® digesters as sold by Ahlstrom Machinery, or their equivalents, or to digesters employing some form of spent liquor pretreatments. This invention also applies to chemical pulping methods employing pulp strength or pulp yield enhancing additives such polysulfide, sodium hydrosulfide, anthraquinone, and their derivative or equivalents.

The two or more digesters of the present invention may also be operated to effect different treatments. For example, one digester may be operated to produce a low kappa pulp, for example pulp having a kappa number less than 20, suitable for Totally-Chlorine-Free (TCF) bleaching, and another digester may produce higher kappa pulp suitable for Elemental-Chlorine-Free (ECF) bleaching. Also, the separate digesters may produce different grades of unbleached kraft pulp, for example, one digester may be operated to produce base-liner and another top-liner for the production of paper board.

The present invention also has the further advantage of providing the potential to use common equipment for the two or more digesters. For example, a common superstructure and support facilities can be used. Also common ancillary equipment may be used for the two or more digesters, for example, common pumps, storage vessels, flash tanks, and cooling and heating equipment, among others.

According to one aspect of the present invention a method of treating comminuted cellulosic fibrous material, using a steaming vessel and a plurality of distinct parallel digesters, is provided. The method comprises the steps of continuously: (a) feeding comminuted cellulosic fibrous material to the steaming vessel in a first stream of material; (b) steaming, slurrying and pressurizing the material from the first stream; (c) substantially simultaneously transferring the steamed, slurried and pressurized material to a plurality of the distinct parallel digesters; and (d) between steps (a) and (c), splitting the first stream of material into a plurality of individually controlled material streams, one for each of the distinct parallel digesters.

Step (d) may be practiced in a wide variety of ways. For example step (d) may be practiced after steaming, slurrying and pressurizing; or after steaming but before slurrying and pressurizing; or after steaming and slurrying but before pressurizing; or in the steaming vessel (e.g. just before discharge from the steaming vessel); or, when slurrying is practiced in a vessel having one dimensional convergence and side relief, in the slurrying vessel (for example just before discharge), in which case there may be the further step of metering the material before steaming and the slurrying vessel. Where step (d) is practiced after steaming, slurrying, and pressurizing, the pressurizing is typically practiced using only one high pressure transfer device (e.g. HPF), and a multi-branch conduit with a branch connected directly to each of the digesters is provided, the HPF and branching portion of the conduit provided substantially at ground level (i.e. not up adjacent the tops of the digesters). Steaming is typically practiced in a chip bin having one dimensional convergence and side relief, although other conventional horizontal or the like steaming vessels may be provided.

According to another aspect of the present invention apparatus for treating comminuted cellulosic fibrous material is provided. The apparatus comprises the following components: a steaming vessel; a plurality of distinct parallel digesters; means for feeding comminuted cellulosic fibrous material to the steaming vessel in a first stream of material; means for slurrying and pressurizing the material from the first stream; means for substantially simultaneously transferring the steamed, slurried and pressurized material to a plurality of the distinct parallel digesters; and, means for splitting the first stream of material into a plurality of individually controlled material streams, one for each of the distinct parallel digesters, the control for the individual streams provided at one or more of the digester itself, the inlet conduit, or a return conduit.

The steaming vessel may be any conventional steaming vessel, but preferably is a chip bin having one dimensional convergence and side relief (sold under the trademark DIAMONDBACK® by Ahlstrom Machinery). The digesters may be continuous or batch digesters, but preferably are continuous digesters. The means for feeding comminuted cellulosic fibrous material to the steaming vessel in a first stream of material may be any conventional equipment, such as the conveyor belt which feeds either directly to the steaming vessel, or through a conventional air lock, or through any other conventional metering or entry device.

The means for slurrying and pressurizing the material from the first stream may also comprise a wide variety of components. For example it may include a conventional chip chute connected between any suitable discharge from the steaming vessel and directly to a high pressure transfer device (e.g. HPF); or it may comprise chip tube connected to a pump and then to the inlet to a high pressure transfer devices (preferably a Kamyr high pressure feeder, although other high pressure transfer devices, such as an IMPCO transfer device, may be utilized); or any of the variety of structures such as illustrated in U.S. Pat. No. 5,476,572 may be utilized. The means for slurrying or pressurizing may include a plurality of high pressure feeders with associated slurrying devices.

The means for substantially simultaneously transferring the steamed, slurried, and pressurized material to a plurality of the distinct parallel digesters (preferably to all of the digesters at once, although one or more of the transfer means may be shut down in a particular situation) typically includes a conduit from the high pressure feeder which is connected either directly, or through a multi-branch conduit where each branch is preferably directly connected, to a digester. The phrase "directly connected" in the present specification and claims means a connection that does not require a significant amount of additional equipment to ensure proper feeding or splitting of the flow, for example not requiring equipment such as illustrated in U.S. Pat. No. 3,849,247. However typically there will be some elements in the directly connected conduit, such as valves, flow controllers, sensors, or the like.

The means for splitting the first stream of material into a plurality of individually controlled material streams, one for each of the distinct parallel digesters, may vary widely. It may comprise a multiple discharge from the steaming vessel, a multiple discharge from a slurrying vessel, multiple high pressure feeders, or a multi-branch conduit (as described above) extending from a single high pressure feeder.

Each of the digesters preferably has an L/D ratio of between about 7–9, and although the digesters may be of approximately the same volume they need not be. For example, should a mill desire expansion of its present capacity, one or more digesters having a larger or smaller volume may be added to the existing digester. The digesters can be of different volumes or throughputs in which case the individual flow controls for the digesters are accommodated appropriately. Individual control for the digesters may be provided not only by valves, flow controllers, sensors, or the like in conduits leading to the digester from the pressurizing device, but also or alternatively in the digesters themselves and/or in return circulations from the digesters, each return circulation having a pump and the pumps being individually controllable.

The details of the separating devices in the digesters (particularly where continuous digesters are utilized), level control for various chip tubes, chip chutes, or the like, controls for high pressure feeders, and the like may have any desired construction and are not part of this invention.

According to another aspect of the invention, apparatus for treating comminuted cellulosic fibrous material is provided comprising the following components: A plurality of distinct continuous parallel digesters. A steaming vessel having a steamed material outlet. A slurrying device having an inlet connected to the steamed material outlet and a slurry outlet. A high pressure transfer device having a slurry inlet connected to the slurrying device slurry outlet, a liquid inlet, and a pressurized slurry outlet. A multi-branch conduit connected to the pressurized slurry outlet, the conduit having a branch directly connected to each of the plurality of distinct parallel digesters. And, a distinct return conduit from each of the digesters to the high pressure transfer device liquid inlet. Each return conduit preferably has a flow measuring and flow control device. Though each return conduit may have a distinct pump associated with it, in the preferred embodiment, only one pump is used, with separate flow controls for the return conduits.

It is the primary object of the present invention to allow for the utilization of manageable size digesters in the chemical pulping of cellulosic fibrous material while still having the ability to treat almost any volume of material at a single installation. This and other objects of the invention will become clear from an inspection of the detailed description of the invention, and from the appended claims.

DETAILED DESCRIPTION OF THE DRAWINGS

Figure 1:
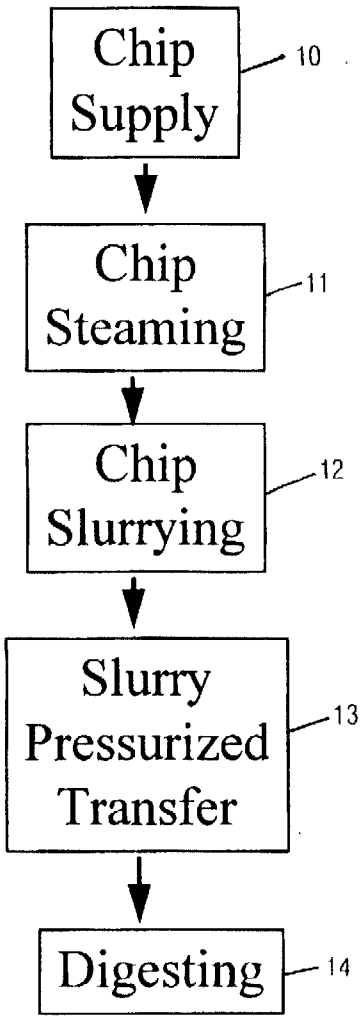
Fig. 1 (Prior Art)
FIG. 1 is a box diagram schematically illustrating the conventional commercial practice in the handling of wood chips to produce chemical pulp.

FIG. 1 schematically illustrates the conventional commercial treatment of wood chips or like comminuted cellulosic material for the production of chemical pulp, such as by sulfate, sulfite, or other known processes. From a chips supply 10, such as an outdoor pile with a conveyor leading from it, chips are fed to any suitable device 11 for chip steaming. In continuous digesting processes typically the chips are first fed to a chip bin where some presteaming takes place, and then to a horizontal steaming vessel, although in some circumstances steaming can take place only in the chip bin itself. Subsequently the steamed chips (steamed to remove the air therefrom) are slurried as indicated schematically at 12 in FIG. 1. In a continuous digester system the slurrying typically takes place in a chip chute, although other slurrying mechanisms such as shown in U.S. Pat. No. 5,476,572 may be utilized. The slurrying typically takes place using a liquid that includes cooking liquor (such as kraft white liquor).

The slurry is typically fed—as illustrated schematically at 13 in FIG. 1—to a pressurizing device. The pressurizing that takes place as indicated in box 13, for continuous systems, preferably is accomplished utilizing a KAMYR® high pressure feeder, sold by Ahlstrom Machinery, although other conventional pressurizing devices can be utilized. Ultimately the pulp is then fed to a single vertical digester where chemical digestion takes place, as indicated schematically at 14 in FIG. 1. The prior art as illustrated in FIG. 1 has the problems discussed above, namely the need to provide extremely large digesters in order to obtain cost effective and economy of scale production of chemical pulp in a pulp mill.

Figure 2:
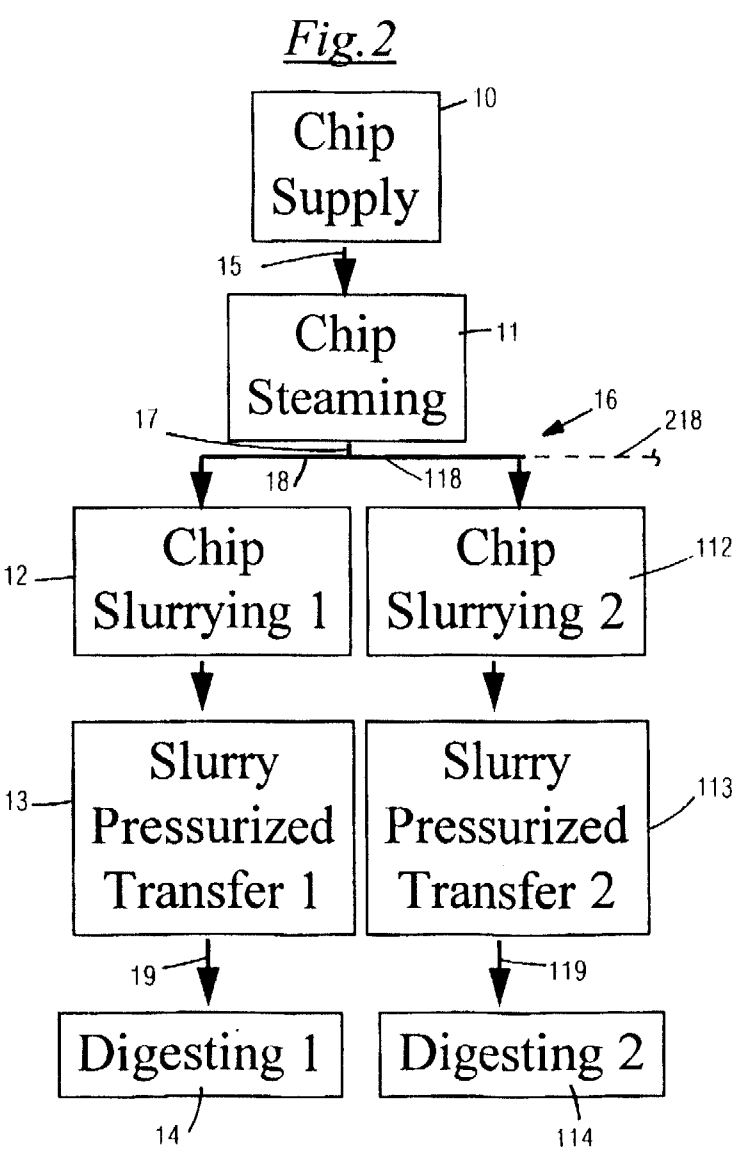
FIGS. 2 through 6 are box diagrams schematically illustrating various methods and procedures according to the present invention for chemical pulping of chips which allow moderate size digesters to be utilized while still allowing almost any quantity of chips to be treated at a particular location.

FIG. 2 schematically illustrates one exemplary form of apparatus according to the present invention for practicing the method according to the present invention, while FIGS. 3 through 6 schematically illustrate several variations of the apparatus and method. The aspects of the method and apparatus in FIGS. 2 through 6 that are comparable to those in FIG. 1 are shown by the same reference numeral, and where multiple units are utilized the multiple units use the same two digit reference numeral preceded by a "1". In all of FIGS. 2 through 6 at least two digesters 14, 114 are provided, and for simplicity of illustration in the drawings only two such digesters are illustrated. However it is to be understood that three or more digesters may be utilized, and depending upon the optimum size of the equipment, the relative sizes of the digesters 14, 114, etc. (they may all be the same size or of different sizes), multiple branching can take place.

In FIG. 2, according to the present invention chips from the chip supply 10 are fed in a first stream 15 to a steaming vessel 11. After the steaming vessel 11, means are provided for splitting the first stream into a plurality of individually controlled material streams, one for each of the digesters 14, 114. Such means are illustrated schematically in FIG. 2 generally by reference numeral 16, as a multi-branch conduit, having a single outlet 17 from the steaming vessel 11, and then branches 18, 118 that go to each of two distinct slurrying devices 12, 112 (which may comprise chip chutes, chip tubes, slurrying vessels, or the like). From the slurrying devices 12, 112 the slurries are fed to the pressurizers 13, 113, from which they are transferred by individual conduits 19, 119 to the digesters 14, 114. Preferably the conduits 19, 119 are directly connected to the tops of the digesters, and particularly where continuous digesters are utilized as the digesters 14, 114 there is a return circulation from each of the digesters 14, 114 back to its individual pressurizing device 13, 113 (such as a high pressure transfer device, like a high pressure feeder).

As briefly indicated above, where more than two digesters 14, 114 are provided there may be another branch conduit at the same location as the branches 18, 118—as indicated schematically by the branch 218 in FIG. 2—or there may be a further splitting, as part of the splitting means, further downstream; for example from the pressurizer 113 there may be a branch conduit instead of the single conduit 119, each branch of the conduit leading to a different digester.

Figure 4:
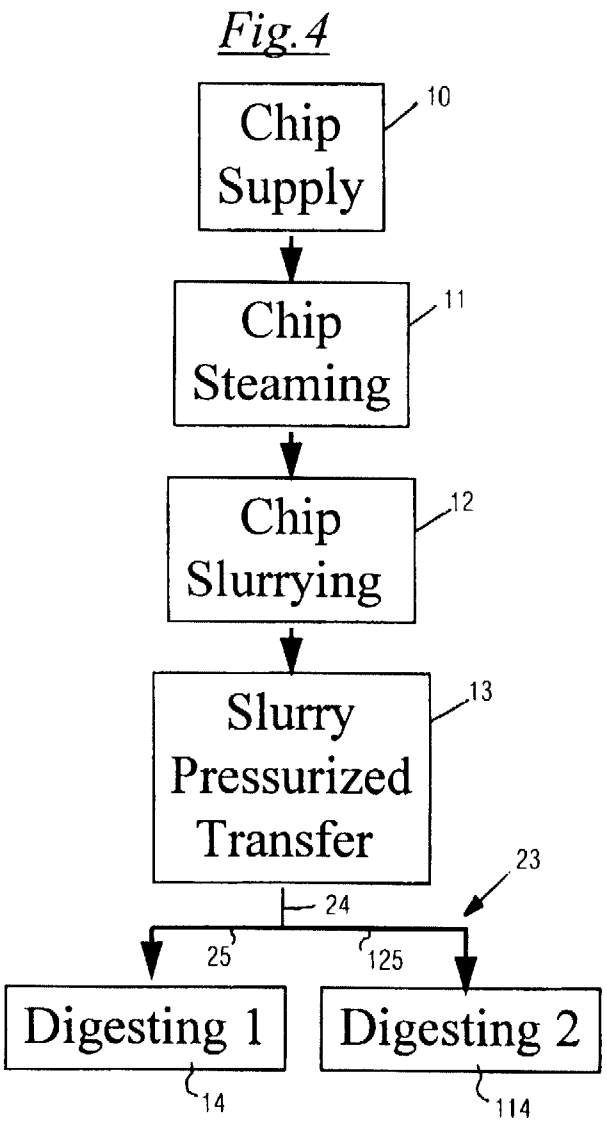
Figure 3:
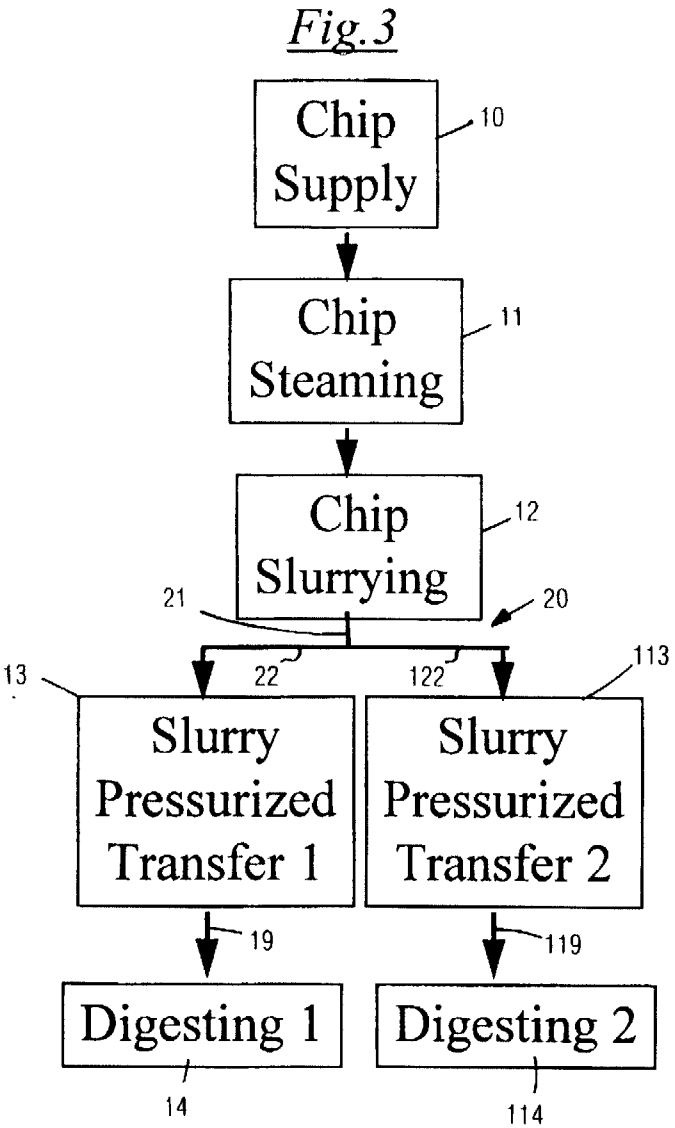

In FIG. 3 the splitting means are illustrated schematically at 20, and comprise a single conduit 21 extending from the chip slurrying device 12, with branch conduits 22, 122 extending therefrom to the individual pressurizers 13, 113. In FIG. 4 the splitting means is illustrated schematically at 23 and is provided between the pressurizer 13 and digesters 14, 114, such as the single conduit 24 extending from the pressurizer 13 and the branch conduits 25, 125 each directly connected to a digester 14, 114.

Figure 5:
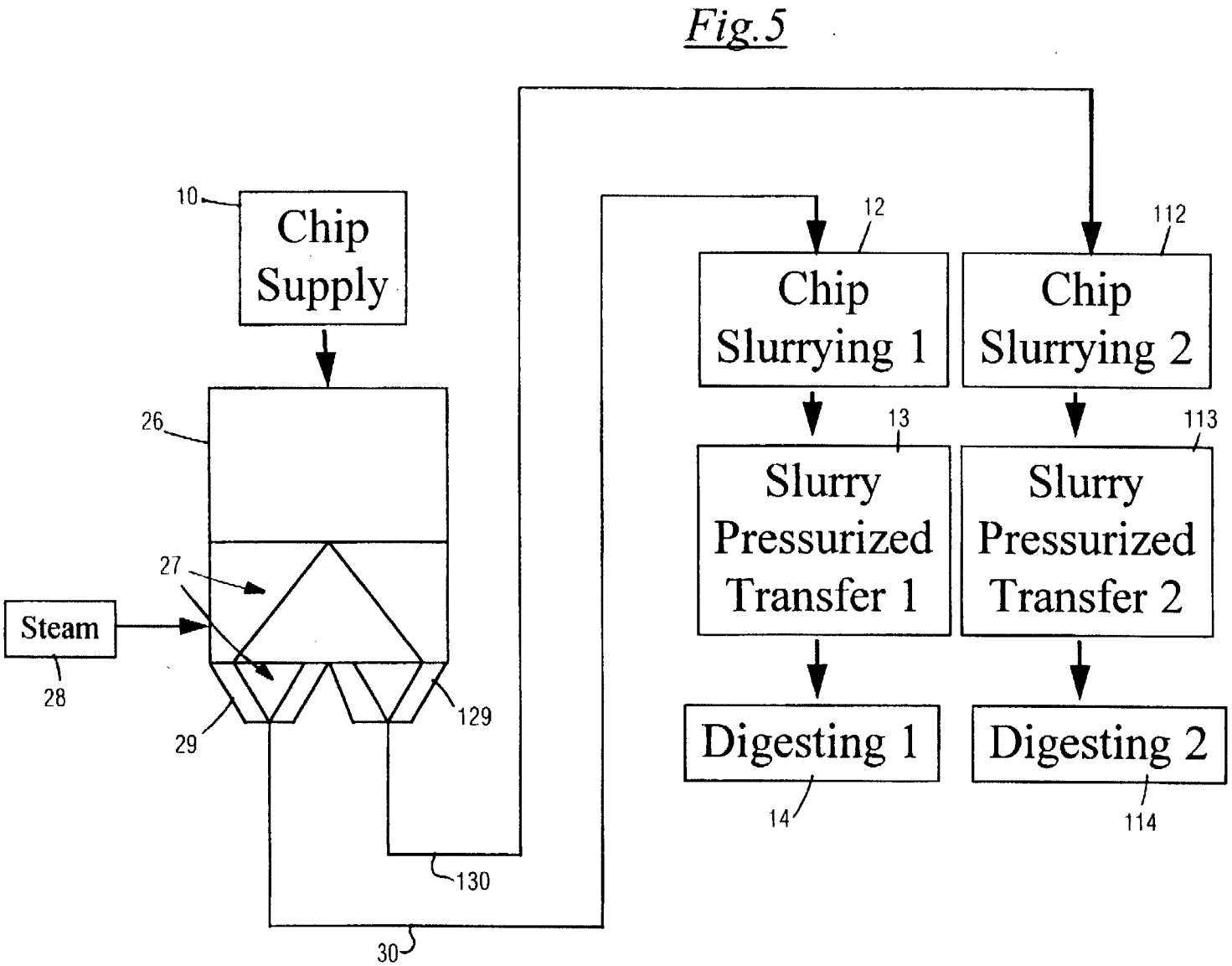

FIG. 5 schematically illustrates a modification of FIG. 2 in which the chip steaming takes place in a chip bin or steaming vessel 26 which has one dimensional convergence and side relief, as schematically illustrated at 27 in FIG. 5. The vessel 26 is preferably a DIAMONDBACK® chip bin or steaming vessel such as sold by Ahlstrom Machinery, steaming provided from any suitable source as illustrated at 28 in FIG. 5, the basic vessel 26 also being illustrated in U.S. Pat. No. 5,500,083 (the disclosure of which is hereby incorporated by reference herein). The splitting of the first stream of material into a plurality of individually controlled material streams in the FIG. 5 embodiment takes place in the vessel 26 itself. For example as schematically illustrated in FIG. 5 splitting takes place just before discharge from the vessel 26, the vessel 26 having two different discharges 29, 129, a conduit 30, 130 leading from each of the discharges 29, 129 to the chip slurrying devices 12, 112. While two outlets 29, 129 with one dimensional convergence and side relief are illustrated in FIG. 5 it is to be understood that the vessel 26 may have more than two discharges 29, 129, or there may be further splitting of the flow of steamed chips from either of the conduits 30, 130. If vessel 26 operates under superatmospheric pressure, some form of pressure isolation device (not shown) may be located between supply 10 and vessel 26.

Figure 6:
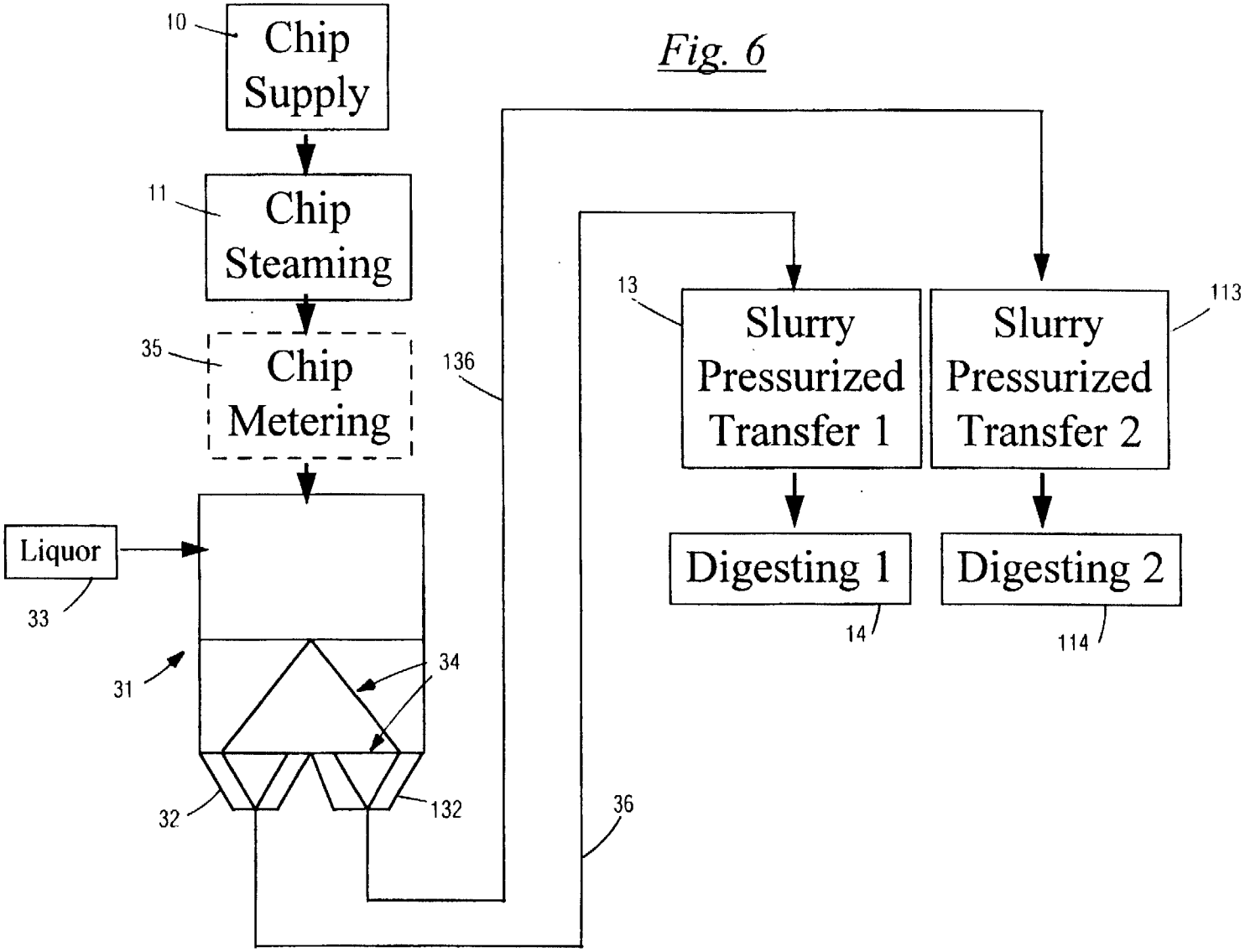

FIG. 6 illustrates a modification of the system of FIG. 3 in which slurrying takes place in a slurrying vessel 31 having two or more outlets 32, 132. Liquor from source 33, including cooking liquor, is added in the vessel 31, the vessel 31 being illustrated having one dimensional convergence and side relief (schematically indicated at 34 in FIG. 6) such as for the vessels in U.S. Pat. No. 5,500,083. In this embodiment the chips may be metered to the slurrying vessel 31, as schematically illustrated at 35 in FIG. 6, the structure 35 comprising any suitable conventional metering device such as a chip meter sold by Ahlstrom Machinery, a metering screw, or the like. A conduit 36, 136 extends from each of the outlets 32, 132 (splitting of the stream taking place in the vessel 31), the conduits 36, 136 leading to the individual pressurizing and transfer devices 13, 113. Again, if vessel 31 operates under superatmospheric pressure, some form of pressure isolation device (not shown) may be located between vessel 11 and vessel 31.

Figure 7A:
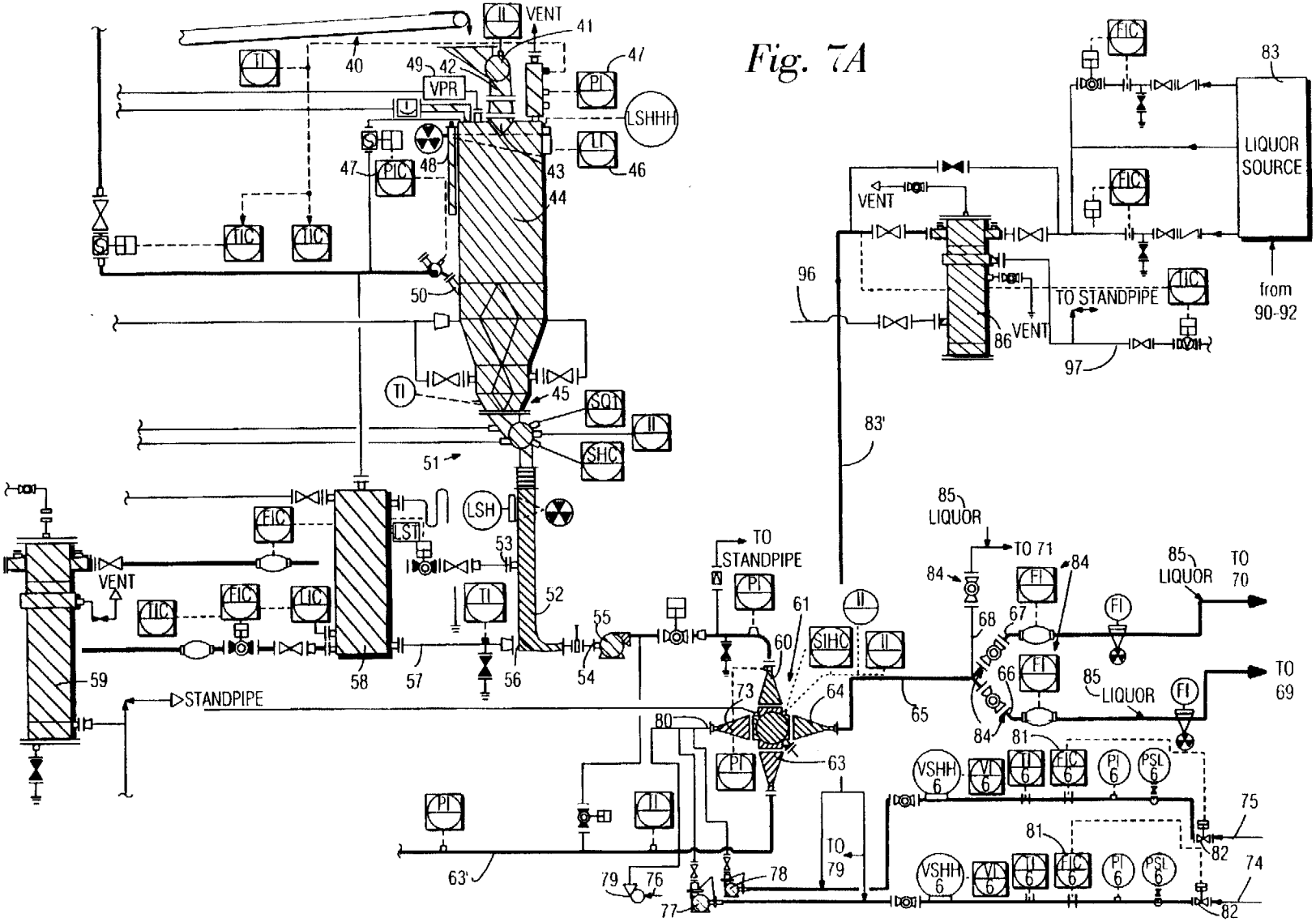
FIGS. 7A and 7B are detail schematic views illustrating a particular embodiment of the apparatus according to the present invention.
Figure 7B:
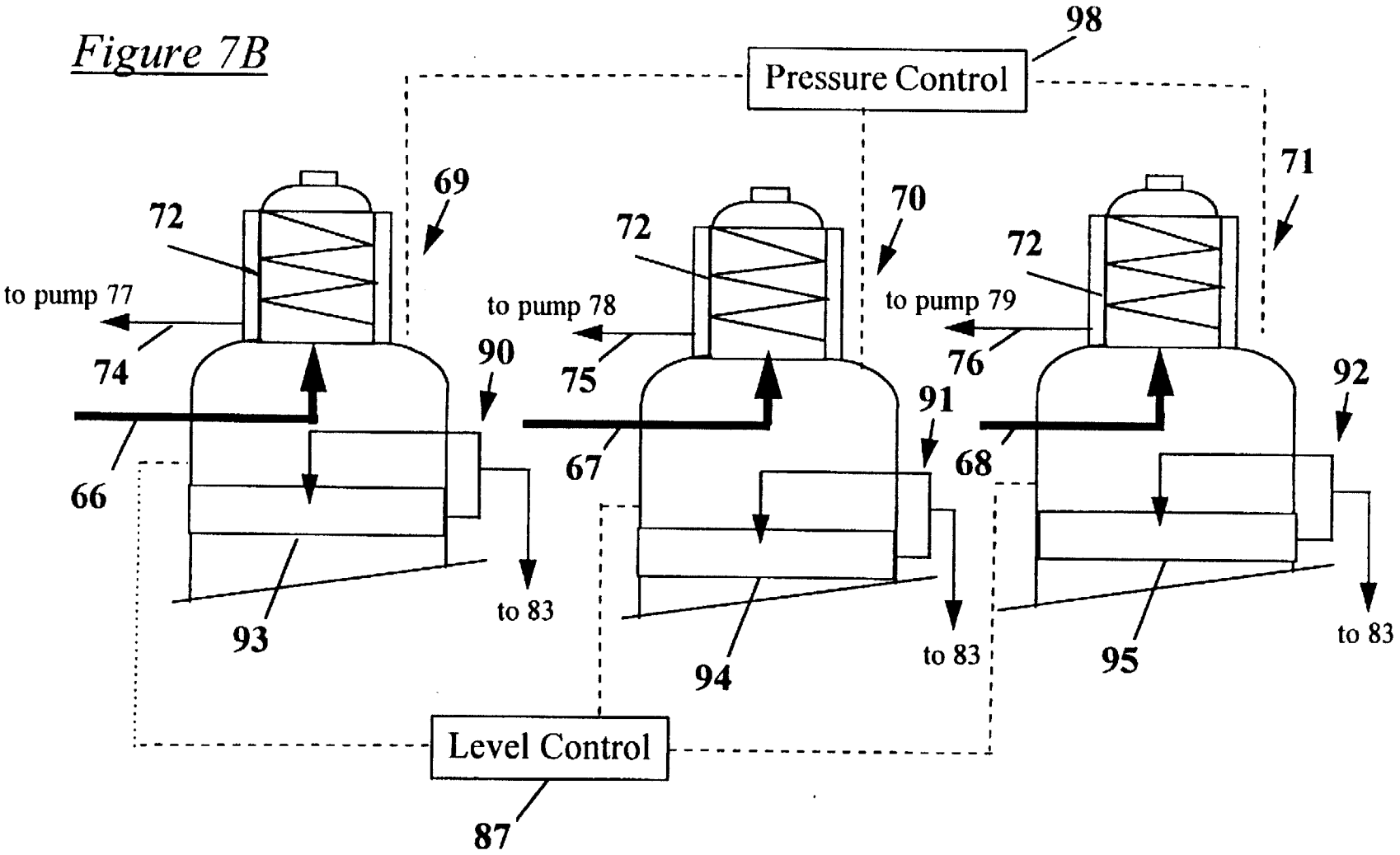

FIGS. 7A and B illustrate a detail of one preferred embodiment of a modification of the system illustrated in FIG. 4. In FIGS. 7A and 7B, the wood chips are introduced via a conventional conveyor 40 to conventional star-type feeder 41 which acts as an air-lock between the atmosphere and the downstream steaming process. The air-lock feeder 41 discharges via a conduit 42 to the inlet 43 of the known per se atmospheric steaming vessel 44. The inlet 43 of this vessel 44 may include counter-weighted trap-doors which further minimize the escape of gases to the atmosphere. The steaming vessel 44 is preferably a DIAMONDBACK® steaming vessel, illustrated in U.S. Pat. No. 5,500,083 and marketed by Ahlstrom Machinery, having an outlet (shown generally at 45) containing one or more transitions having geometry exhibiting one-dimensional convergence and side-relief. The vessel 44 also typically includes the following conventional components: gamma-radiation level indicator 46, pressure indicators 47, temperature indicator elements 48, and a pressure and vacuum relief device 49. Steam is introduced to this vessel 44 via one or more nozzles 50 at various elevations. The steam may be fresh steam, for example low pressure steam at approximately 450 KPa (65.25 psi) absolute and 150° C. (302° F.), or the steam may be "dirty" or residual steam generated in a liquor flashing process (e.g. from a black liquor flash tank).

The steamed chips are discharged from the steaming vessel 44, without the aid of mechanical agitation or vibration, as is characteristic of the DIAMONDBACK chip bin, to a chip meter 51. The chip meter 51 acts as a metering device for controlling the flow of chips out of the steaming vessel 44. The chip meter 51 "i.d. 51 on FIG. 7A" discharges the steamed chips, via a flexible bellows connection, to a conduit or Chip Tube 52. Cooking liquor, for example sulfite liquor, kraft white liquor, green liquor or black liquor, is introduced to the steamed chips in the tube 52 by means of one or more nozzles 53. The liquor provided to nozzle 53 may be heated or, preferably, cooled via heat exchanger 59. This liquor creates a slurry of chips and liquid which under the force of gravity is carried to the inlet 54 of a slurry pump 55. This flow of chips and liquor to the pump 55 is aided by the radiused discharge 56 of the tube 52 and the introduction of additional liquor by one or more conduits 57 to the radiused discharge 56. The additional liquor is provided by a liquor surge tank 58 as disclosed in co-pending application Ser. No. 08/428,302 filed on Apr. 25, 1995. The tank 58 may be provided with liquor from heater or cooler 59 or from another source. The pump 55 is preferably a "Hidrostal" centrifugal slurry pump with inducer, supplied by Wemco of Salt Lake City, Utah.

The pump 55 discharges the slurry at between approximately 200 and 400 KPa (30–60 psi) directly to the low pressure inlet 60 of high-pressure transfer device 61, preferably a conventional High-Pressure Feeder (HPF) sold by Ahlstrom Machinery having a pocketed rotor 62. The liquor in the slurry passes through the rotor 62 and a screen in the low pressure outlet 63 of the HPF 61 and is returned via conduit 63' to the liquor surge tank 58 via a conventional sand separator (not shown), in-line drainer (not shown), and level tank (not shown), all sold by Ahlstrom Machinery. Preferably at least some of the liquor returned to the surge tank 58 is passed through the conventional heat exchanger 59, preferably operated as a white liquor cooler. The cooler 59 allows for the control of the temperature of the treatment, for example as disclosed in co-pending application Ser. No. 08/460,723 filed on Jun. 2, 1995.

The slurry is discharged from the high-pressure outlet 64 of the HPF 61 to a conduit 65 having a bifurcation (or multiple branches) or flow divider that divides the flow of chips and liquor into two or more separate flows. The separate flows (in branches 66–68) pass to two (or more) separate digesters 69–71, (see FIG. 7B) respectively, being directly connected thereto. Where branches 66–68 begin is preferably substantially at ground level (i.e. not near the inlets to the digesters 69–71). The digesters 69–71 preferably are modified cooking continuous digesters, for example Lo-Solids® or EMCC® digesters as marketed by Ahlstrom Machinery, but any suitable digesters (including of different types or constructions) may be provided. Of course, this multiple-feed system may also be used for conventional continuous digesters, hydraulic or vapor-phase, or for conventional or modified batch digesters.

In FIG. 7B, each digester 69–71 typically includes a liquor separating device (shown schematically at 72 in each) in its inlet, for example, a conventional screw-type top separator or inverted top separator. Some of the liquor is separated from the slurry in the separators 72 and returned to the liquid (high pressure) inlet 73 of the HPF 61 via the distinct, individually controllable return conduits 74–76, respectively. Each conduit 74–76 may have a pump 77–79 (see FIG. 7A) therein, for example a Top Circulation Pump (TCP). As shown in FIG. 7A, three digester return flows may be pumped by three separate pumps 77–79 to the high-pressure inlet 73 of the HPF 61. The 77–79 supply the motive force for transferring the slurry out of the HPF 61 to the digesters 69–71. Though the flows out of the pumps 77–79 can be regulated by a single flow-control valve located in the single line 80 upstream of the HPF 61, it is preferred that the flow of liquor to these pumps be regulated independently by separate flow meters 81 and flow control valves 82 in each return line 74–76. This separate, independent flow control can be regulated, for example, using a ratio of one flow to another, so that the flow of chips to each digester 69–71 can be varied depending on the desired slurry flow thereto.

In a preferred embodiment, only one pump, for example, one TCP pump (like pump 77), can be used to return liquor to the HPF 61 from two or more digesters 69–71. In this mode, the flow from each of the digesters 69–71 is preferably regulated independently, for example, by means of separate flow meters and valves in lines upstream or downstream of the TCP pump.

The liquor returned in lines 74–76 from the digesters 69–71 to the pumps 77–79 may be supplemented via line 83' by spent cooking liquor, that is, black liquor, extracted from the cooking process as schematically illustrated at 83 in FIG. 7A. Liquor from a source 85 (different from or the same as 83) can also or alternatively be added to branches 66–68, which branches 66–68 may also have flow control devices or meters therein as illustrated generally at 84 in FIG. 7A. The liquor from source 83 may be extracted anywhere in the process but is preferably extracted early in the cooking stage. For example, liquor supply 83, is preferably liquor removed from cooking circulations 90–92, associated with screens 93–95, shortly after impregnation. The spent cooking liquor (e.g. at 83) from the two or more digesters 69–77, may be combined and passed to a conventional heat exchanger or cooler 86 to cool the liquor before introducing it to the pumps 77–79, or lines 74–76. The cooler 86 may be used to heat another fluid 96 that requires heating, for example fresh water, white liquor or washer filtrate, for example "cold blow" filtrate used for dilution in Lo-Solids® cooking, to produce a heated liquid 97.

The digesters 69–71 used in this invention may be vapor-phase digesters having both a liquor level control and a chip level control. For example, the digesters preferably have some form of gas "pad" at their top. This gas may be air, oxygen, nitrogen, steam, or any other suitable gas. The pressure of this gas may be independently regulated by, for example, a pressure controller 98. By monitoring and maintaining both a liquor and chip level within each digester 69–71—as illustrated schematically by controls 87 in FIG. 7B—the variations in the division of the liquor and chips can be monitored and the addition of cooking chemical, for example at 85 or to the top of the digesters 69–71 and other liquors adjusted accordingly.

The feeding configurations illustrated can be combined as desired to feed more than three digesters, for example four or even eight or more digesters.

It will thus be seen that according to the present invention an advantageous method and apparatus have been provided for treating of comminuted cellulosic fibrous material so as to allow the use of optimum size digesters (e.g. having an L/D ratio of between about 7–9, and a cost effective size) while still allowing almost any tonnage of pulp to be produced at a particular mill, and while also allowing different types of pulp to be produced at the same mill. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent methods and apparatus.

What is claimed is:

1. A method of treating comminuted cellulosic fibrous material, using a steaming vessel and a plurality of distinct parallel digesters, comprising the steps of continuously:

(a) feeding comminuted cellulosic fibrous material to the steaming vessel in a first stream of material;

(b) steaming, slurrying with liquid, and pressurizing the material from the first stream, to provide a liquid slurry;

(c) substantially simultaneously transferring the liquid slurry to a plurality of the distinct parallel digesters; and (d) between steps (a) and (c) splitting the first stream of material into a plurality of distinct, individually controlled material streams, one for each of the distinct parallel digesters.

2. A method as recited in claim 1 wherein step (d) is practiced after steaming, slurrying and pressurizing, to provide one slurry stream to each digester.

3. A method as recited in claim 2 wherein pressurizing is practiced using only one high pressure transfer device, and a multi-branch conduit with a branch directly connected to each of the digesters.

4. A method as recited in claim 1 wherein step (d) is practiced after steaming and before slurrying and pressurizing.

5. A method as recited in claim 1 wherein step (d) is practiced after steaming and slurrying and before pressurizing.

6. A method as recited in claim 1 wherein slurrying is practiced using at least one high pressure transfer device.

7. A method as recited in claim 1 wherein step (d) is practiced in the steaming vessel.

8. A method as recited in claim 7 wherein step (d) is practiced just before discharge from the steaming vessel.

9. A method as recited in claim 7 wherein steaming is practiced in a chip bin having one-dimensional convergence and side relief.

10. A method as recited in claim 1 wherein step (c) is practiced to transfer slurry to all of the distinct parallel digesters at once.

11. A method as recited in claim 1 wherein slurrying is practiced in a vessel having one-dimensional convergence and side relief, and wherein step (d) is practiced in the slurrying vessel.

12. A method as recited in claim 11 comprising the further step of metering the material between steaming and the slurrying vessel.

13. Apparatus for treating comminuted cellulosic fibrous material comprising:

a steaming vessel;

a plurality of distinct parallel digesters;

means for feeding comminuted cellulosic fibrous material to said steaming vessel in a first stream of material;

means for slurrying and pressurizing the material from the first stream to produce a liquid slurry;

means for substantially simultaneously transferring the liquid slurry to a plurality of said distinct parallel digesters; and means for splitting the first stream of material into a plurality of distinct, individually controlled material streams, one for each of the distinct parallel digesters.

14. Apparatus as recited in claim 13 wherein said means for splitting comprises a discharge from said steaming vessel.

15. Apparatus as recited in claim 13 wherein said slurrying means comprises a slurrying vessel; and wherein said means for splitting comprises a discharge from said slurrying vessel.

16. Apparatus as recited in claim 13 wherein said means for splitting comprises a multi-branched conduit connected between said pressurizing means and said digesters, said conduit having one branch directly connected to each digester; and wherein said pressurizing means comprises a single high pressure transfer device at substantially ground level.

17. Apparatus as recited in claim 13 wherein said steaming vessel comprises a chip bin with one-dimensional convergence and side relief.

18. Apparatus as recited in claim 13 wherein said pressurizing means comprises a plurality of high pressure feeders.

19. Apparatus as recited in claim 13 wherein each of said digesters has an L/D ratio of between about 7–9, and are of approximately the same volume.

20. Apparatus for treating comminuted cellulosic fibrous material comprising:

a plurality of distinct continuous parallel digesters;

a steaming vessel having a steamed material outlet;

a slurrying device having an inlet connected to said steamed material outlet; and a slurry outlet;

a high pressure transfer device having a slurry inlet connected to said slurrying device slurry outlet, a liquid inlet, and a pressurized slurry outlet;

a multi-branch conduit connected to said pressurized slurry outlet, said conduit having a branch directly connected to each of said plurality of distinct parallel digesters; and a distinct return conduit from each of said digesters to said high pressure transfer device liquid inlet, each return conduit having a distinct flow control device.

* * * * *